US011103060B1

(12) United States Patent
Ho

(10) Patent No.: US 11,103,060 B1
(45) Date of Patent: Aug. 31, 2021

(54) EXTENDED TABLE WITH A GEAR ASSEMBLY

(71) Applicant: ELITE MODERN, Santa Fe Springs, CA (US)

(72) Inventor: Robinson Ho, Cerritos, CA (US)

(73) Assignee: ELITE MODERN, Santa Fe Springs, CA (US)

( * ) Notice: Subject to any disclaimer, the term of this patent is extended or adjusted under 35 U.S.C. 154(b) by 0 days.

(21) Appl. No.: 17/096,670

(22) Filed: Nov. 12, 2020

(51) Int. Cl.
*A47B 1/05* (2006.01)
*A47B 13/08* (2006.01)
*A47B 21/03* (2006.01)

(52) U.S. Cl.
CPC ..... *A47B 1/05* (2013.01); *A47B 13/088* (2013.01); *A47B 21/03* (2013.01)

(58) Field of Classification Search
CPC .. A47B 1/05; A47B 1/04; A47B 1/056; A47B 2001/053; A47B 13/088
See application file for complete search history.

(56) References Cited

U.S. PATENT DOCUMENTS 829,439 A * 8/1906 De Simone ..... A47B 1/056 108/66
1,043,567 A * 11/1912 Burnham ..... A47B 1/04 108/77
1,077,826 A * 11/1913 Frisina ..... A47B 1/04 108/69
1,993,787 A * 3/1935 Howe ..... A47B 1/04 108/77
2,492,139 A * 12/1949 Eliason ..... A47B 1/04 108/66
4,510,980 A 4/1985 Bartlett
4,971,488 A 11/1990 Mihara et al.
5,156,095 A * 10/1992 Hansbaek ..... A47B 1/03 108/66
5,237,937 A * 8/1993 Peltier ..... A47B 13/088 108/66
5,542,317 A 8/1996 Carter et al.
5,682,658 A 11/1997 Roseliep
6,009,814 A * 1/2000 Rossi ..... A47B 1/05 108/66
6,935,250 B1 8/2005 Arnold
8,555,791 B2 10/2013 Jin et al.
9,907,393 B2 * 3/2018 Rossi ..... A47B 1/10
9,924,791 B2 * 3/2018 Bortolato ..... A47B 1/05
2004/0194672 A1 * 10/2004 Conley ..... A47B 1/02 108/83
2006/0075940 A1 * 4/2006 Dodge ..... A47B 1/03 108/86

(Continued)

*Primary Examiner* — Daniel J Rohrhoff
(74) *Attorney, Agent, or Firm* — Kanika Radhakrishnan; Evergreen Valley Law Group

(57) ABSTRACT

The present invention provides an extended table for use as a piece of furniture, comprising a table with a top surface, two or more leaves lying at least partially parallel on adjacent planes in the unextended position, and being possible to draw the leaves apart in a plan view and each leaf is supported by a crank arm which is obliquely placed at a certain degree on the leaf, a gear assembly is housed in the table base connects the cranks arms together so that they can be moved angularly simultaneously with respect to one another. In the extended position, the leaves lie in the same plane as the table surface.

19 Claims, 16 Drawing Sheets

(56) References Cited

U.S. PATENT DOCUMENTS

| | | | | |
|---|---|---|---|---|
| 2006/0156963 | A1* | 7/2006 | Fischer | A47B 13/023 108/69 |
| 2009/0050032 | A1* | 2/2009 | Conley | A47B 1/056 108/66 |

* cited by examiner

EXTENDED TABLE WITH A GEAR ASSEMBLY

TECHNICAL FIELD

The present invention relates to furniture, and more particularly to an extended table with a gear assembly.

DESCRIPTION OF RELATED ART

Conventionally, an extendable table typically has its tabletop formed by two movable halves. When the two halves are pulled apart, one or two additional boards may be placed there between manually to provide an extended tabletop. Alternatively, additional boards may be unfolded to extend the table and folded down to be stored below the tabletop. Such known arrangements require a multi-stage operation and thus are less convenient to use.

An adjusting round table including a circular core plate that is isosceles-trapezium-shaped with a column, is shown in CN108420182. A rotation split level desktop with a double-layered tabletop is shown in CN108618365. A round table supported by a pedestal structure is shown in CN105996432. An extended table in which a number of table top sections are caused to move outwardly and expand upon rotation of the tabletop, is shown in U.S. Pat. No. 7,849,803. An expanding table in which the tabletop is coupled to a guide plate, that defines the positions between the sections, is shown in U.S. Pat. No. 6,994,032. An extended table, comprising a tabletop layer, a guide layer, an actuation layer, a central axis, and a base, is shown in U.S. Pat. No. 6,009,814. A table comprising two leaves and lying one on top of the other in two parallel and adjacent planes, is shown in U.S. Pat. No. 5,458,070. An extended table in which leaves or sections are stored beneath the central member that expand according to the size of the table is shown in U.S. Pat. No. 829,439. An extended table with extension leaves that can be readily pushed in and drawn out, is shown in U.S. Pat. No. 351,101.

In addition to providing the features and advantages described hereinafter, there is a need for the invention to provide an extendable table suitable for dining or the like wherein an extended surface substantially in the form of a ring and that retracts the leaves easily under the main table without any hindrance.

SUMMARY AND OBJECTS OF THE INVENTION

The primary objective of the present invention is to provide an extendable table that is easy to operate.

The present invention provides an extended table for use as a piece of furniture, comprising a table with a top surface, two or more leaves lying at least partially parallel on adjacent planes in the unextended position, and being possible to draw the leaves apart in a plan view and each leaf is supported by a crank arm which is obliquely placed at a certain degree on the leaf, a gear assembly housed in the table base connects the cranks arms together so that they can be moved angularly simultaneously with respect to one another. In the extended position, the leaves lie in the same plane as the table surface. Further, the surface shape of the leaves may be such that they are concealed by the table surface in the unextended position and, in the extended position, they are placed side-by-side to the table surface. The shapes of the table surface and the leaves may be identical or different.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

Figure 1:
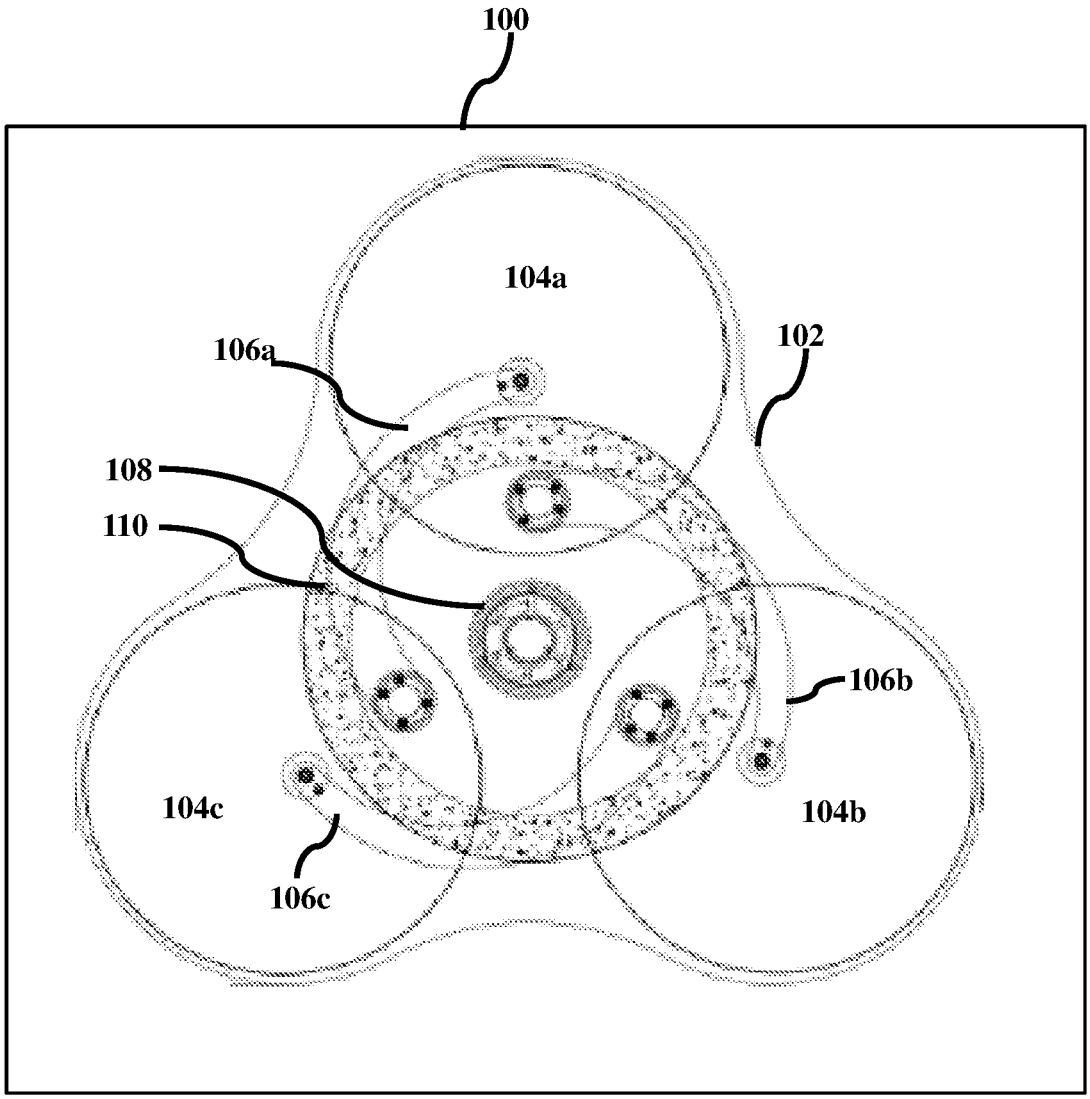
FIGS. 1 and 2 show a lateral view and a plan view respectively of a first embodiment of the table, in the unextended position.

The drawings referred to in this description are not to be understood as being drawn to scale except if specifically noted, and such drawings are only exemplary in nature.

DETAILED DESCRIPTION OF THE PREFERRED EMBODIMENT

In the following description, for purposes of explanation, numerous specific details are set forth in order to provide a thorough understanding of the present disclosure. It will be apparent, however, to one skilled in the art that the present disclosure can be practiced without these specific details. In other instances, systems and methods are shown in block diagram form only in order to avoid obscuring the present disclosure.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification is not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

Moreover, although the following description contains many specifics for the purposes of illustration, anyone skilled in the art will appreciate that many variations and/or alterations to said details are within the scope of the present disclosure. Similarly, although many of the features of the present disclosure are described in terms of each other, or in conjunction with each other, one skilled in the art will appreciate that many of these features can be provided independently of other features. Accordingly, this description of the present disclosure is set forth without any loss of generality to, and without imposing limitations upon, the present disclosure.

Design and Operation of the Table:

With reference to FIGS. 1 to 4, in the preferred embodiment, the table 100 includes a table surface 102 having a central portion that stretches to a shape delimited by the arcs of a circle at each end. 104*a*-104*c* indicate the three circular leaves having approximately the same radius as that of circular arcs of the table surface 102. Each of the leaves 104*a*, 104*b*, and 104*c* is connected to a crank arm 106*a*, 106*b*, and 106*c* respectively, which is obliquely placed at a certain degree to the leaf. The crank arm 106*a*, 106*b*, 106*c* is pivotally connected at one end to a support plate on the bottom of the table and is kinetically linked to a gear assembly 108 so that they can be moved angularly simultaneously with respect to one another. The gear assembly 108 is housed by the table base 110. The gear assembly 108 comprises a tensioning snap or clamp means which blocks the rotation of at least one of the gears and crank arms in one or more of the positions assumed during rotation, thereby controlling the movement of the leaves 104*a*-104*c*.

Figure 3:
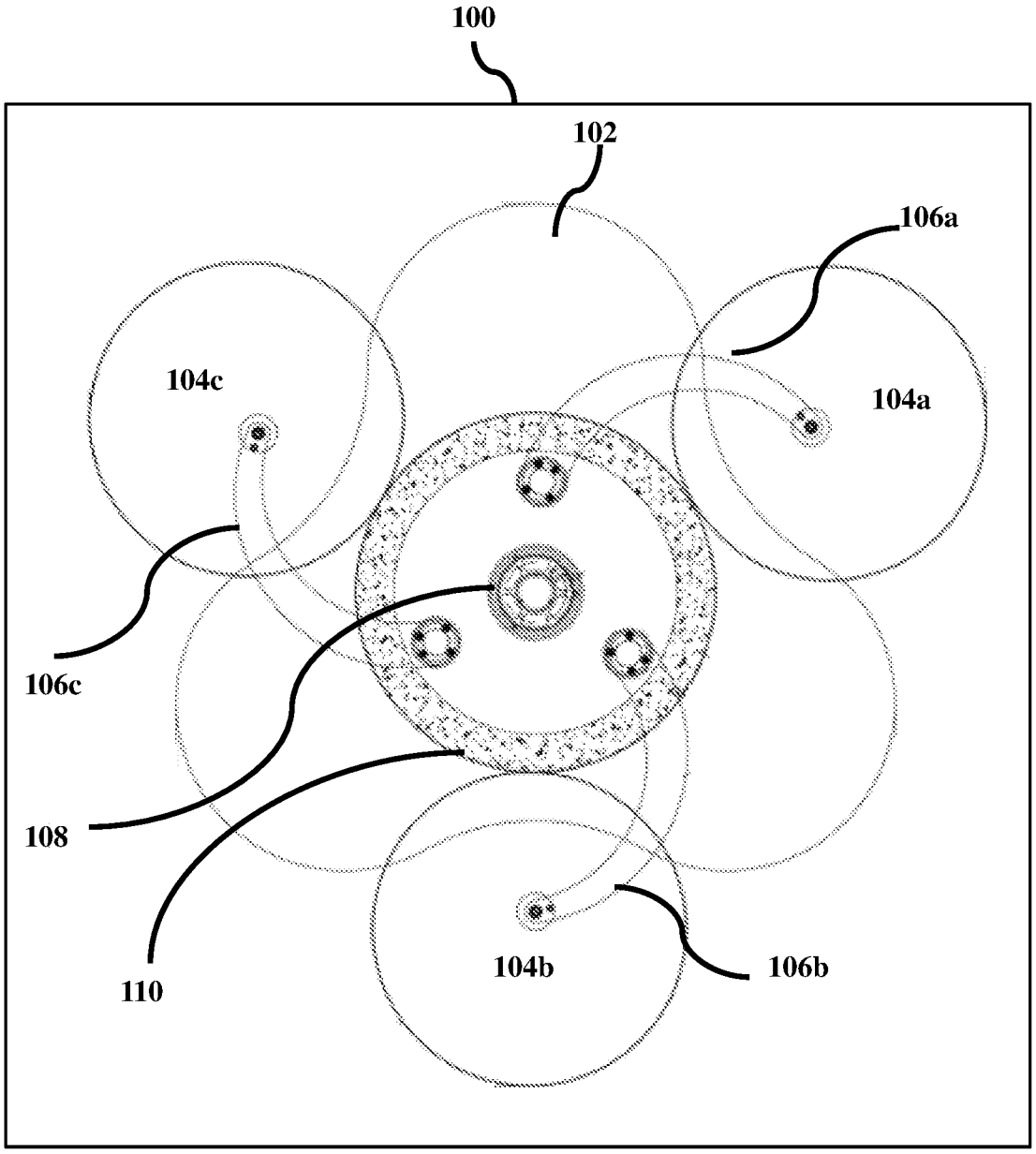
FIGS. 3 and 4 show a lateral view and a plan view respectively of the table of FIG. 1 in the extended position.
Figure 4:
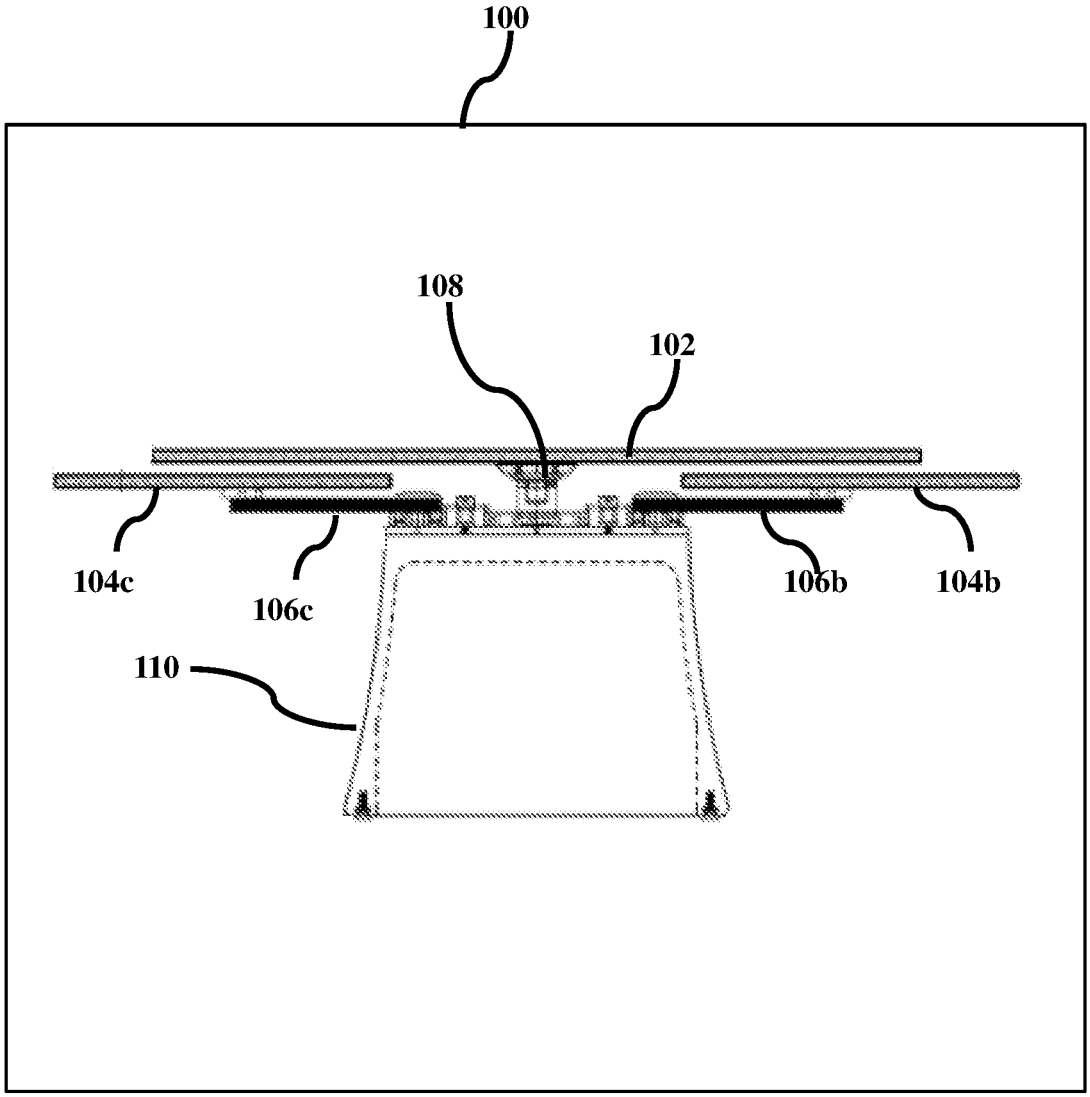

Therefore by rotating the leaves 104*a*-104*c* through manual operation in the horizontal plane and a counterclockwise direction through an angle equal to or slightly less than 180 degrees, the leaves 104*a*-104*c* are driven by the gear assembly 108 to execute a similar rotation in the same direction and the table 100 assumes the configuration shown in FIGS. 3 & 4, in which the support arms 106*a*-106*c* are pulled apart and their ends are distanced from one another to an extended position.

Figure 2:
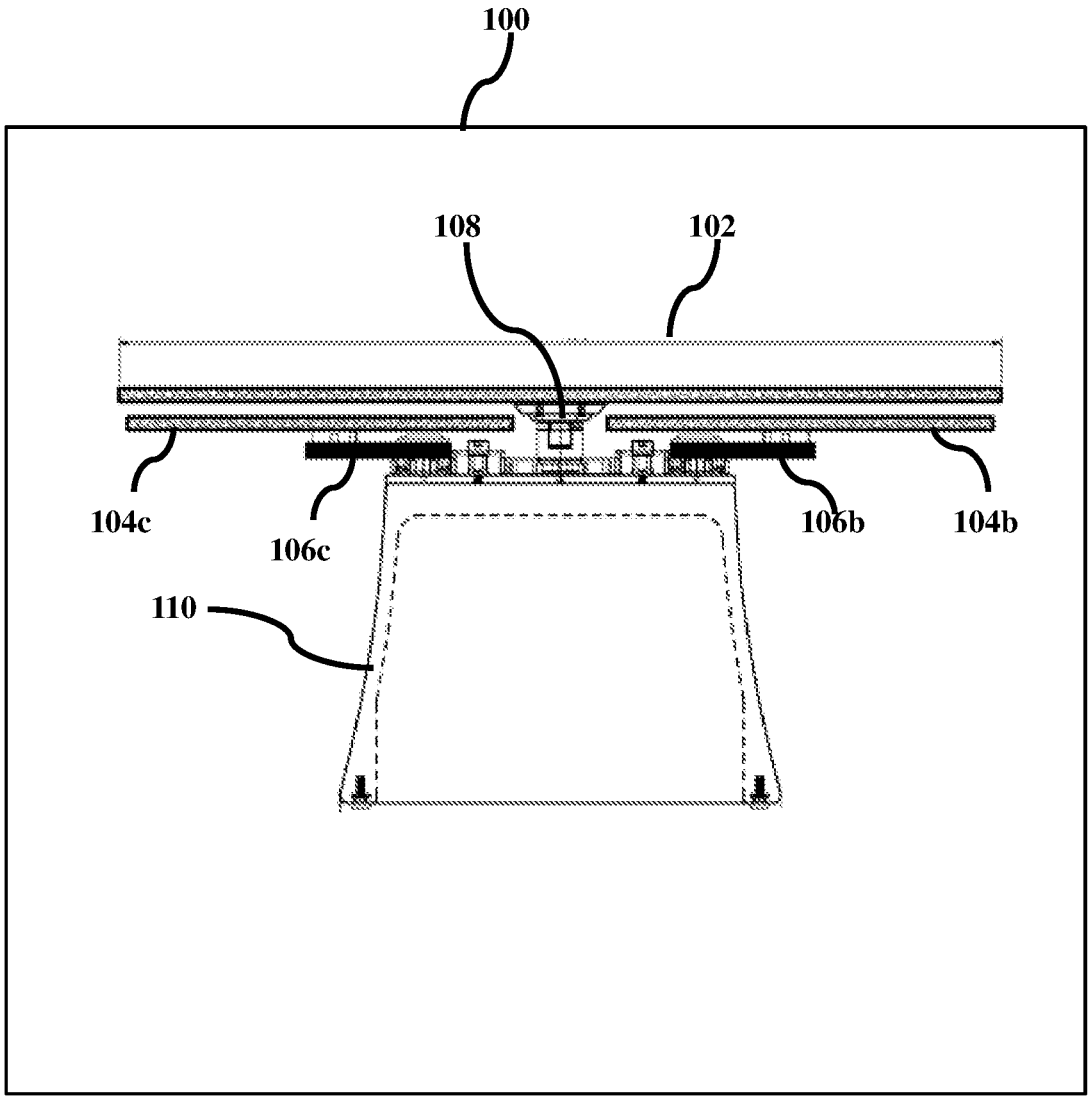

By rotating the leaves through manual operation in the horizontal plane and a clockwise direction through an angle equal to or slightly less than 180 degrees, the leaves 104*a*-104*c*, driven by the gear assembly 108 execute a similar rotation in the same direction and the table 100 assumes the configuration shown in FIGS. 1 & 2, in which the support arms 106*a*-106*c* are pulled closer and their top ends are drawn nearer to an unextended position.

In the extended position the leaves 104*a*-104*c* lie in the same plane as the table surface 102. Further, the surface shape of the leaves 104*a*-104*c* may be such that they are concealed by the table surface 102 in the unextended position and, in the extended position, they are placed side-by-side to the table surface 102. The shapes of the table surface 102 and the leaves 104*a*-104*c* may be identical or different.

Gear Assembly:

FIGS. 5 to 11 are intended for purposes of illustration of the geometry for supporting two indexing positions and the operating principles of the gear assembly by which the table may be precisely driven using a central stationary gear, a first planetary gear and a second planetary gear are arranged in a powertrain manner in which the driving force is imparted to the table 100, and by which the table 100 may be locked in position so that no external force directed against the table will cause any movement thereof. The gears of the gear assembly are made of high strength material such as aluminum metal and the edges of teeth of each of the gears are set at a predetermined angle to a rotational center axis thereof.

Figure 6:
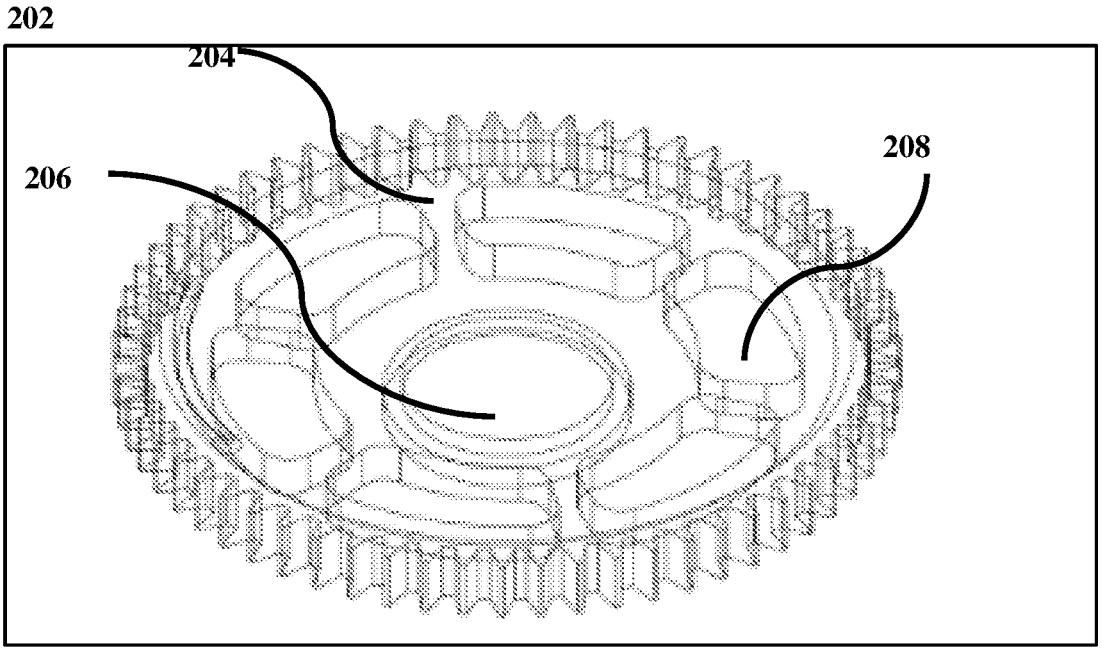
FIG. 6 illustrates the first gear of the gear assembly for the table, in accordance with the present invention.

The center stationary gear 202 that is the first gear 202, as shown in FIG. 6, comprises of a base support web 204 with a cylindrical boss 206 at the central region and the multiple spacing 208 at the peripherals of the support web. The cylindrical boss 208 is designed to receive a column 210 that fits the first gear onto a desired position of the base plate through a ball bearing. Further, the first gear 202 is connected to the table surface 102 through a support plate by one or more pivot screws/studs.

Figure 7:
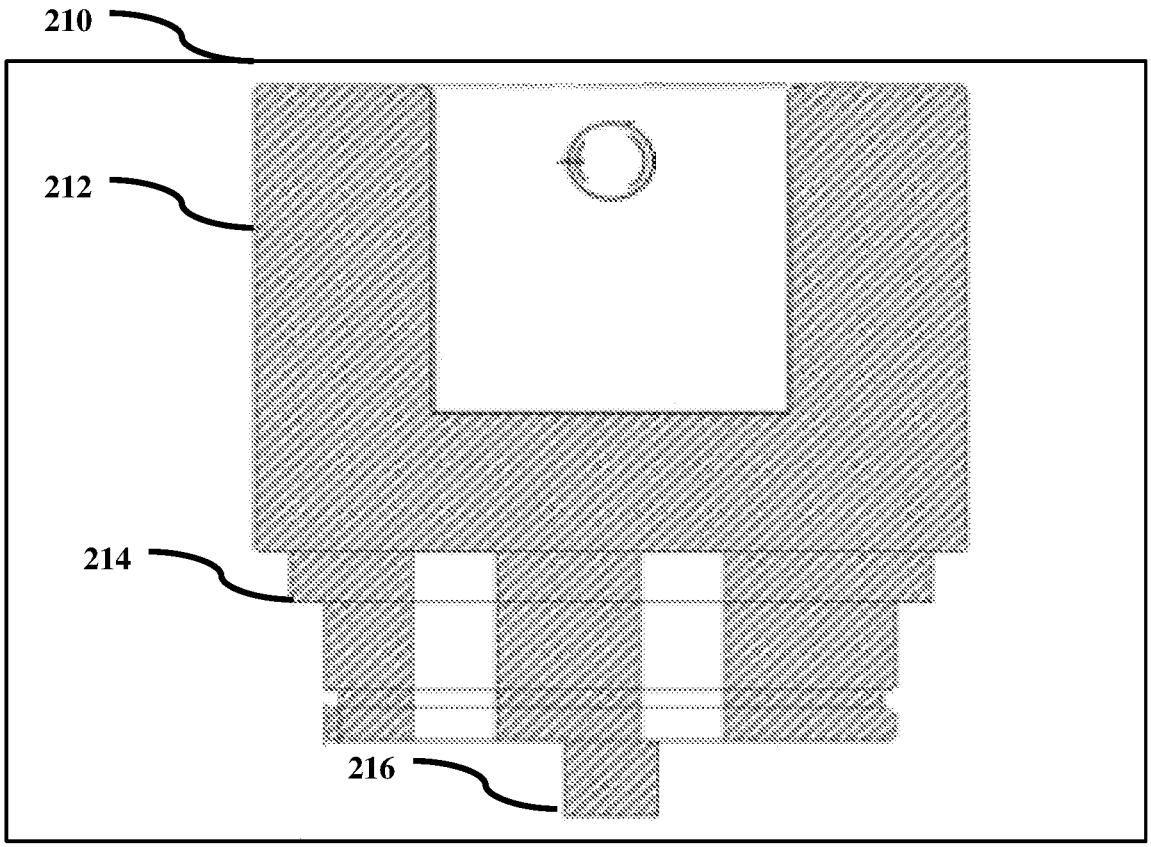
FIG. 7 illustrates the column of the first gear of the gear assembly for the table, in accordance with the present invention.

The column 210 as shown in FIG. 7 comprises an upper unthreaded portion 212, a lower threaded portion 214 and pivotal support pin 216 at the base. The threaded portion 214 includes a circular clip for receiving a clamp spring and may be composed of stainless steel.

Figure 5:
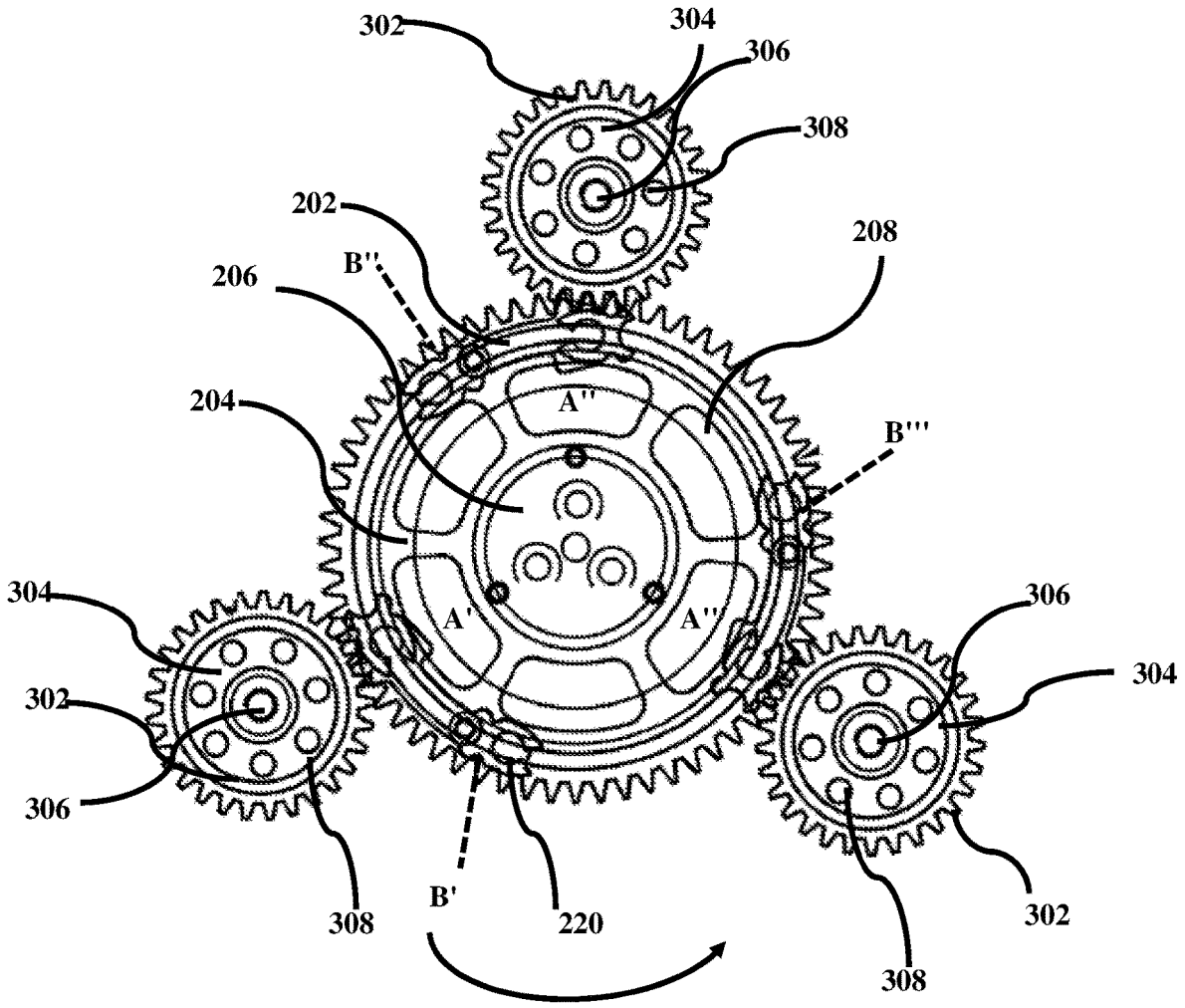
FIG. 5 is a fragmentary view of the gear assembly for the table, in accordance with the present invention.

The first gear 202 includes an elevated inner ring that acts as a track that hingedly connects the snap and clamp means such as U-shaped or V-shaped nylon clip(s) 220 equidistantly, in coherence with the circumferential angular movement between the unextended position and the extended position as shown in FIG. 5. The number of nylon clips is twice the number of the leaves and the second gears.

Figure 8:
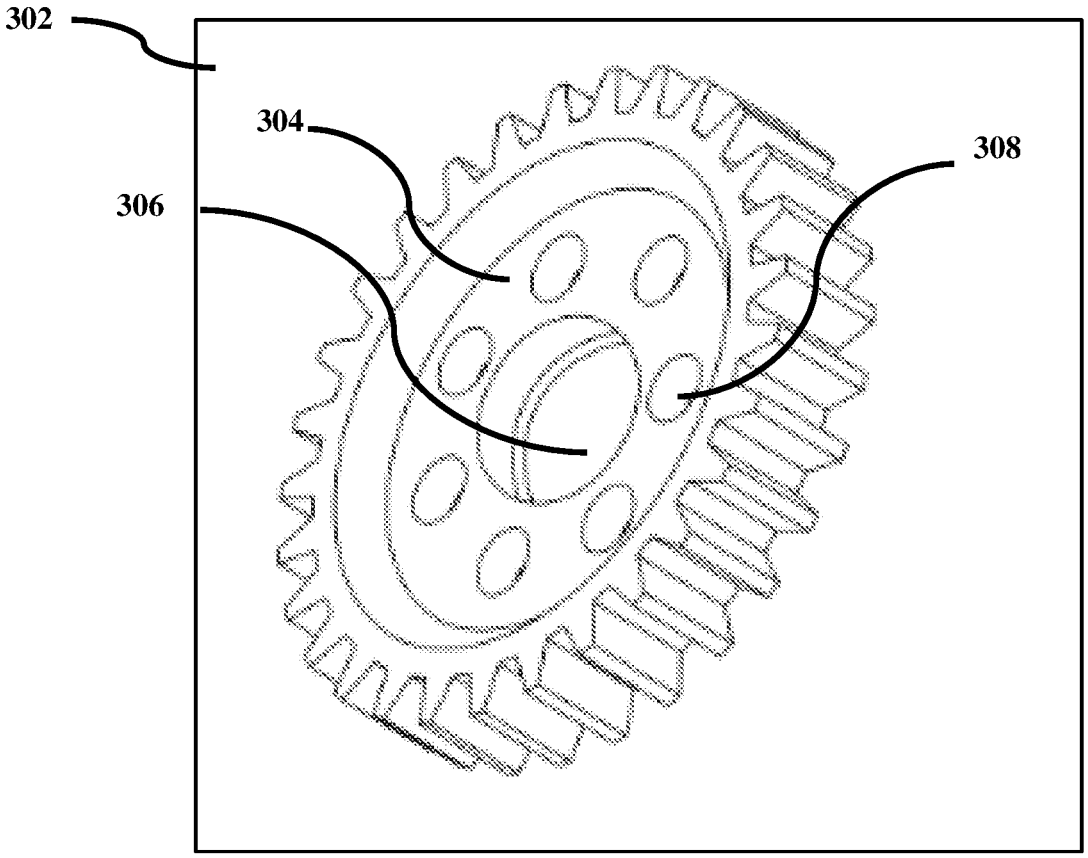
FIG. 8 illustrates the second gear of the gear assembly for the table, in accordance with the present invention.

The first planetary gear 302 that is the second gear, as shown in FIG. 8, has a support web 304 with a cylindrical boss 306 at the central region and the multiple spacing 308 at the peripherals of the support web 304. The cylindrical boss 306 is designed to receive a column 310 to fit the second gear to the base through the flange bearings.

Figure 9:
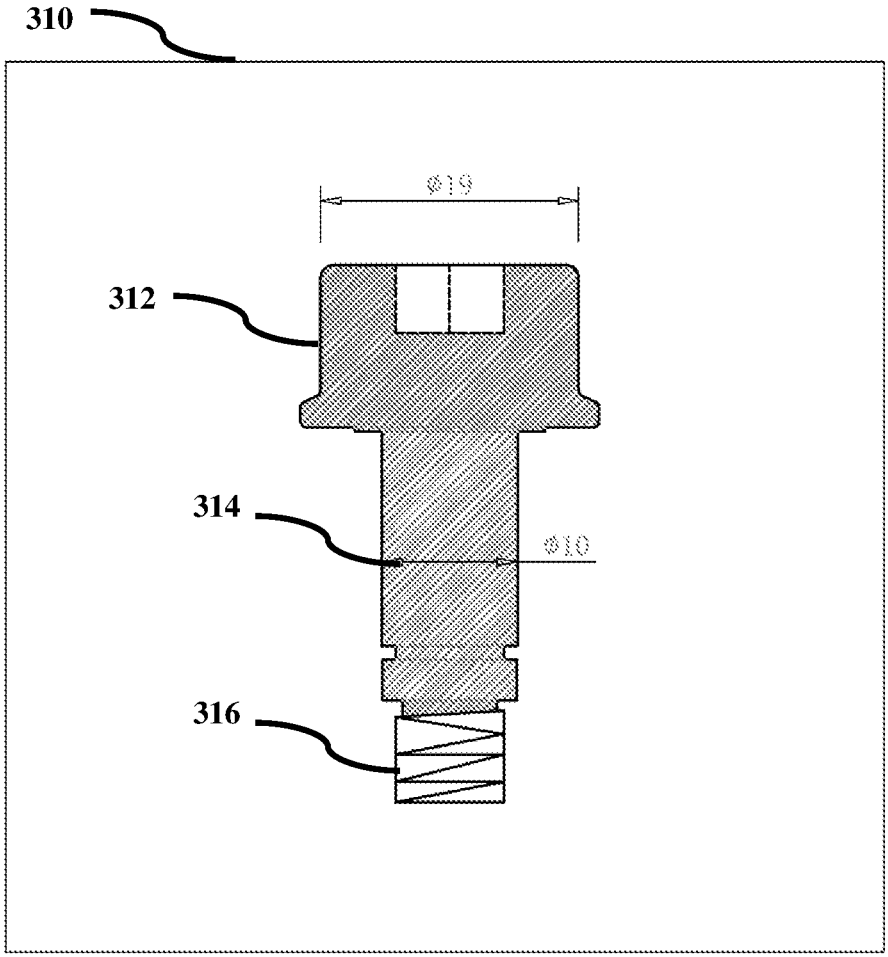
FIG. 9 illustrates the column of the second gear of the gear assembly for the table, in accordance with the present invention.

The column 310 as shown in FIG. 9 comprises an upper unthreaded portion 312, a unthreaded portion 314 and a threaded portion 316 at the base. The unthreaded portion 314 includes a circular clip for receiving a clamp spring and may be composed of stainless steel.

Figure 10:
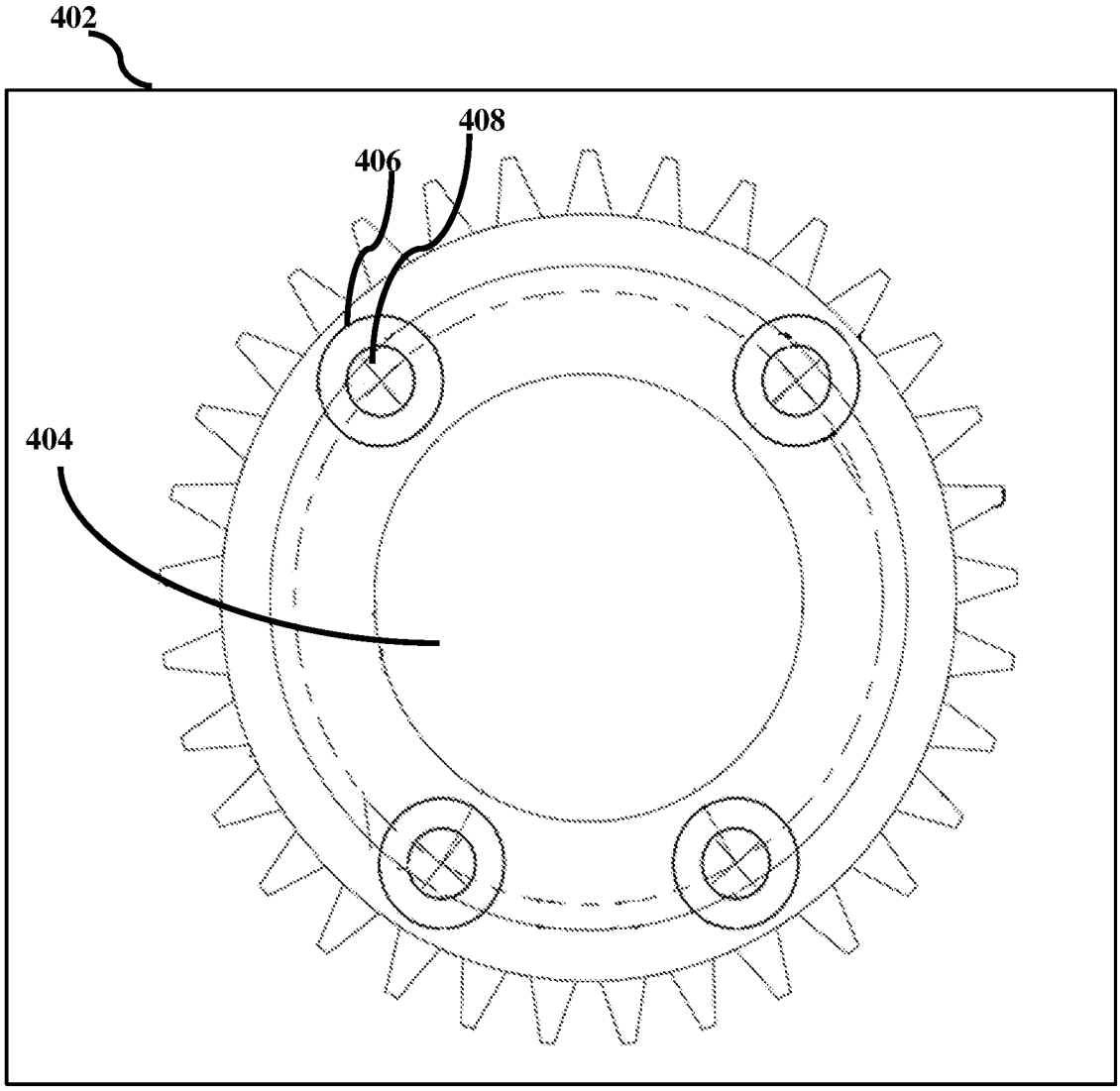
FIG. 10 illustrates the third gear of the gear assembly for the table, in accordance with the present invention.

The second planetary gear 402 that is the third gear, as shown in FIG. 10 has a support web 404 with spacing 406 at peripherals designed to receive a column 408 to fit a plane bearing at the bottom. The number of the third gear is equal to the number of leaves.

Figure 11:
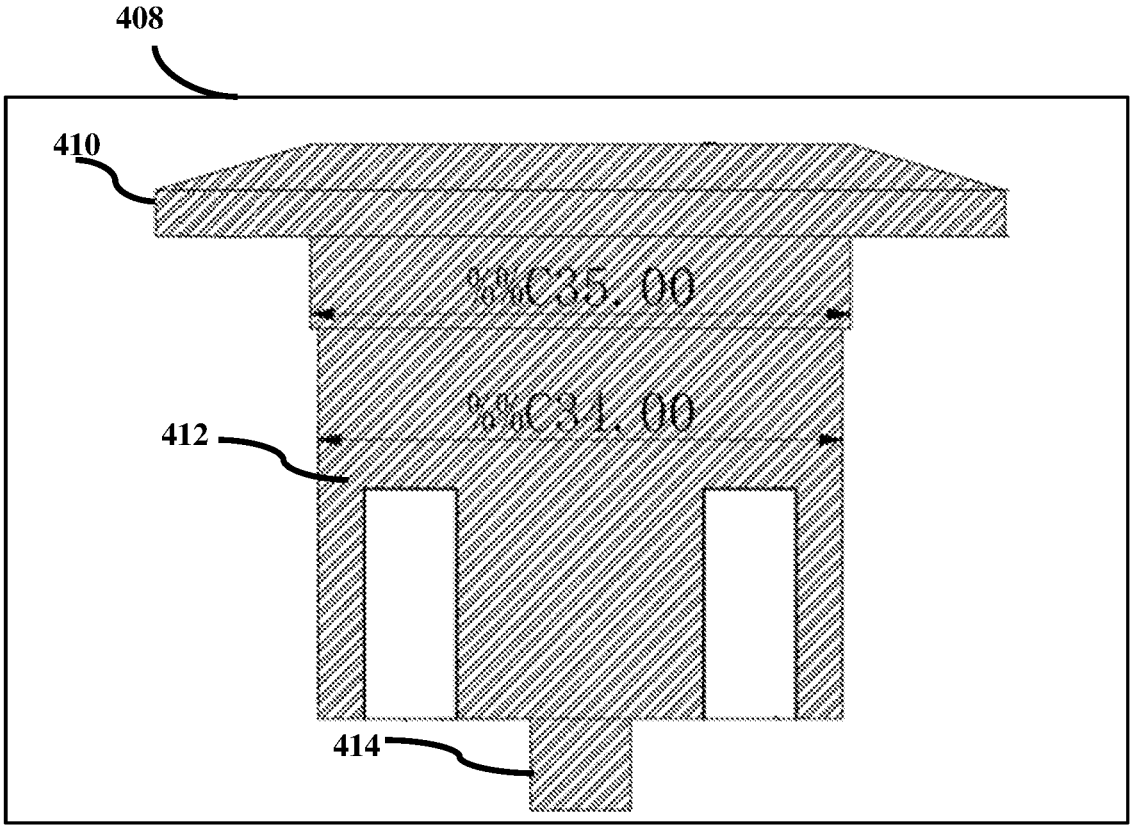
FIG. 11 illustrates the column of the third gear of the gear assembly for the table, in accordance with the present invention.

The column 408 as shown in FIG. 11 comprises an upper unthreaded portion 410 with curved arcs, a lower threaded portion 412 and a pivotal support pin 414 at the base. The threaded portion 412 includes a circular clip for receiving a clamp spring. According to one embodiment the column may be composed of an aluminum alloy. The number of the second gear is equal to the number of leaves.

Figure 12:
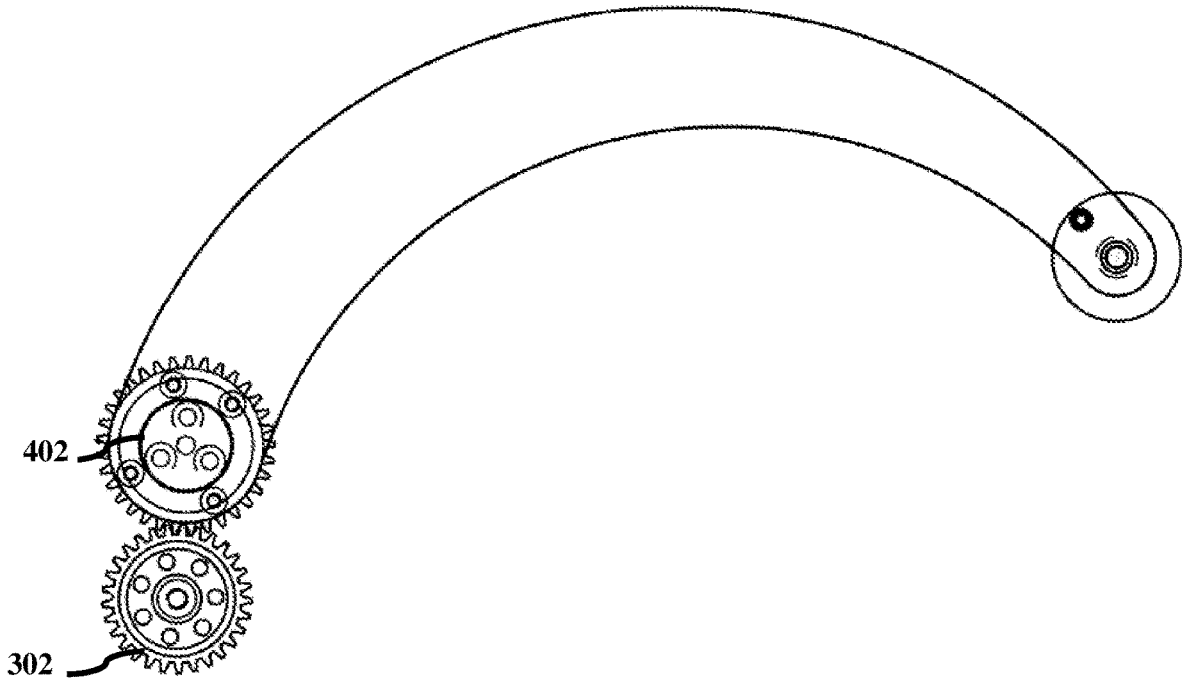
FIG. 12 shows the transmission connection of the second and third gears for the table, in accordance with the present invention.

In the preferred embodiment, as shown in FIG. 12, the second gears 302, are provisionally attached to the central gear 202 in such a way that the second gears 302 are coupled to the snap and clamp means and rotatably moves all the leaves 104*a*-104*c* simultaneously in the indexing directions through the connected respective crank arm 106*a*-106*c* and the third gears 402.

Each tooth of the second gear 302 is superimposed on each tooth of the first gear 202 with a slight displacement there between and a gap is present between adjacent sets of the superimposed teeth, as shown in FIG. 5. Each of the second gears 302 are equidistantly placed in-line with the leaves of the table. For example in the extended position the gears are placed at A', A", A'" of the snap and clamp means, that traverse and lock at B', B", B'" in the unextended position. The first and the second gears 202 and 302 are engaged by the third gear 402 and mated therewith, as shown in FIG. 12. When the gear assembly is mated to the third gear 402, each tooth of the first gear 202 can be forced into that gap between the adjacent sets of the superimposed teeth of the gear assembly, with the result that the teeth of the first gear 202 push the teeth of the second gear 302 in the counterclockwise/clockwise direction, causing reaction force to the second gear 302, to move the third gear 402 connected to the crank arm 106*a*-106*c* in the same direction as the rotation in a symmetrical fashion thereby causing enough torque for the leaves of the table to draw in the unextended or the extended position based on the direction of the rotation caused by manual operation. According to an embodiment, the manual operation may be performed using a hand-wheel disposed at the table base connected to the gear assembly.

According to an embodiment, the diameter of the central stationary gear 202 is relatively twice that of the planetary gears 302 and 402 and, the diameter of planetary gears 302 and 402 is relatively the same. The ratio of the teeth between the first gear 202, the second and third gears 302, and 402 may be 21:9:11. It will be obvious to those skilled in the art that other geometries may be employed, whereby there maybe three or four, or more, indexing positions. In such instances, the diameter of the planetary gear with respect to the stationary gear, and the number of teeth on the planetary gears to the number teeth on the stationary gear may be one-third or one-quarter, and so on.

Figure 13:
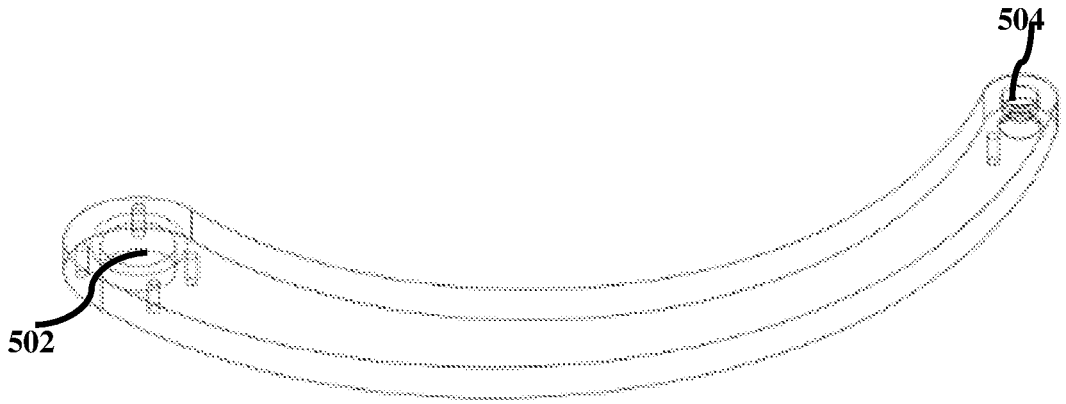
FIG. 13 illustrates the crank arm for the table, in accordance with the present invention.

Structure of the Support Arm:

The crank arm 106*a*-106*c*, as shown in FIG. 13 is shaped such that it does not interfere with it the relative movement of the leaves 104*a*-104*c*.

The crank arm 106*a*, 106*b*, 106*c* comprises a first mounting-boss portion 502 and a second mounting-boss portion 504, which define a long axis of crank arm 106*a*-106*c* and the mounting-boss portions 502, 504 are substantially solid to absorb concentrated forces applied to crank arm 106 by the gear assembly 108. A first mounting means and a second mounting means are located within first and second mounting-boss portions 502, 504. The first mounting means attaches the crank arm 106*a*, 106*b*,106*c* to the leaves 104*a*, 104*b*,104*c* of the table by fasteners such as bolts and screws and is glued to the lateral surface of the leaves through a support plate (e.g. a stainless steel puck). The second mounting means kinetically attaches the crank arm 106*a*, 106*b*,106*c* to the gear assembly 108 through a stud housed on the table base 110. The stud is a lead screw that comprises an unthreaded portion, a hexagonal head in the upper-end portion and a spring support base at the lower end portion. The unthreaded portion, and the hexagonal head are separated by a short threaded portion. The unthreaded portion is rotatably mounted in a plain bearing which is housed in the base with the spring support that provides the necessary thrust bearing between the stud and the base.

Figure 14:
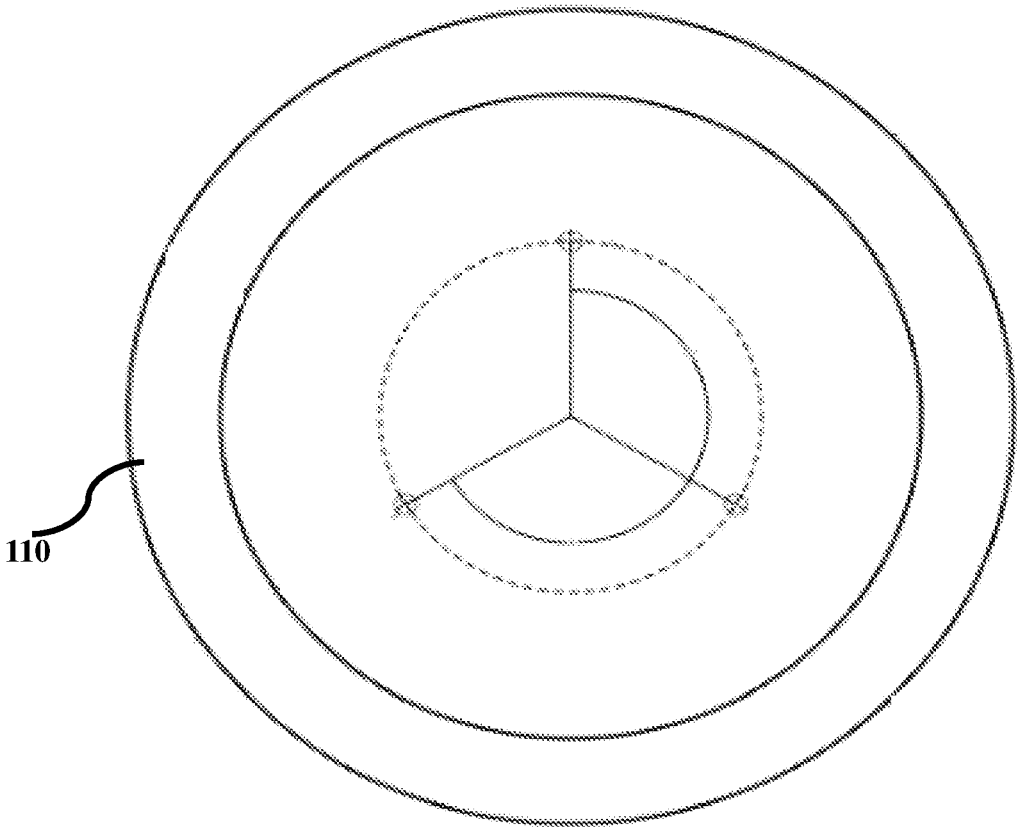
FIG. 14 illustrates the top view of the table base for the table, in accordance with the present invention.
Figure 15:
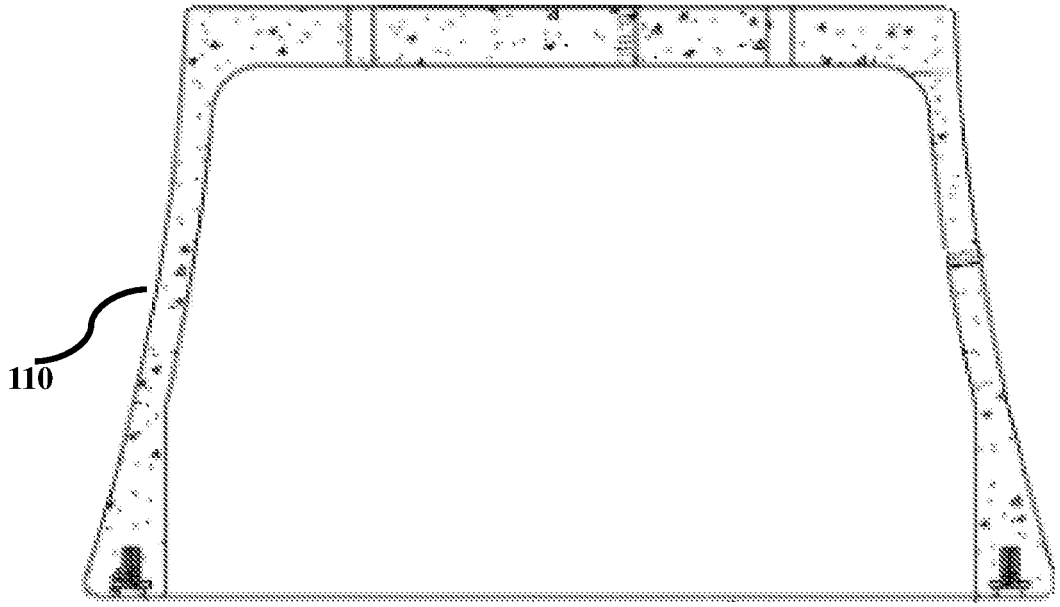
FIG. 15 illustrates the cut-away view of the tablebase for the table, in accordance with the present invention.

Structure of the Table Base:

The table base 110 as shown in FIGS. 14 and 15 is designed to allow table 100 be placed on the table base 110 to be aligned vertically without a visible and disturbing gap arising above the surface of the floor. In the preferred embodiment, a table base 110 comprises a top base and a hollow, vertical column, connected to a hollow, horizontal base. The lower portion of the vertical column is fabricated into a shape conforming to the complementary shape defined as per the shape of the table and the shape of the extended leaves, such that the edges of the interlocking connections between the components of the table 100 resist both lateral and rotational forces applied during the extension of table 100. The vertical column and horizontal base have widths of similar dimensions. When the vertical column and horizontal base are connected, similar widths of the vertical column and horizontal base provide a sturdy and aesthetically pleasing connection by mating all edges of the joint between the vertical column and horizontal base. Further, the table base may be built from a rigid material such as cement and the like.

Figure 16:
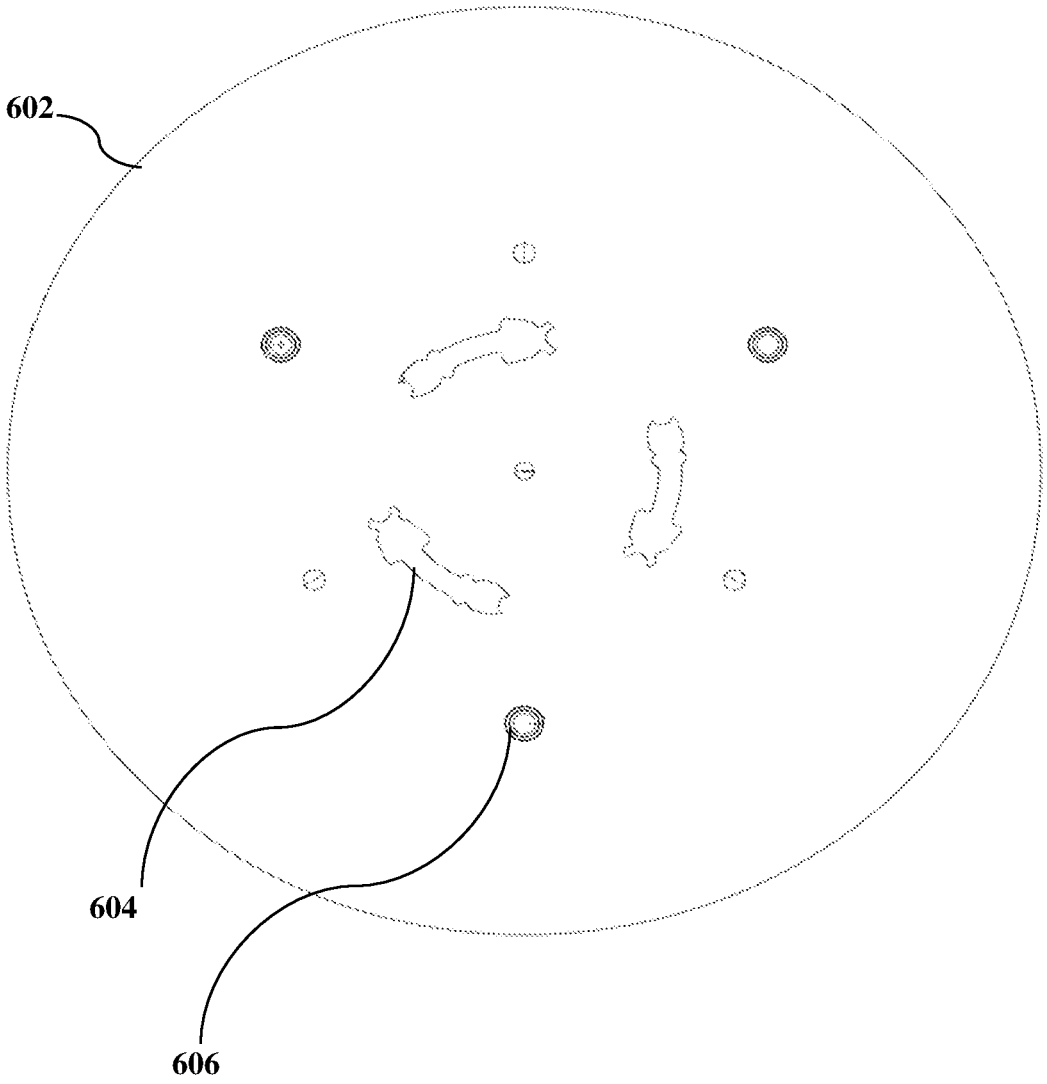
FIG. 16 illustrates the top view of the upper plate for the table, in accordance with the present invention.

Further, as illustrated in FIG. 16, an upper mounting plate 602 is rigidly attached in the top base, aligned with the vertical column. The upper mounting plate 602 is configured to engage the table surface 102, with screws through apertures in the plate. The base also has threaded holes 606 designed for receiving and securely holding the gear assembly 108, and also includes circumferentially curved grooves 604 to fit the snap and clamps means of the gear assembly 108.

The configuration of the extended table is non-limiting. The top portions of the table can form a top surface of the extended table that has generally circular configurations, oval configurations, square configurations, rectangular configurations, etc. The pattern used to form one or more of the top portions of the extended table is non-limiting. For example, one or more of the top portions can include a solid surface, a slatted surface, a glass surface, a plastic surface, a metal surface, a cross-hatched surface, etc. The extended table can be made of many types of materials (e.g., metal, wood, glass, ceramic, stone, bamboo, plastic, etc.). As can be appreciated, the extended table can be made of more than one type of material. The length, width and/or height of the extended table is non-limiting. The color of the extended table is non-limiting.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omissions and substitutions of equivalents are contemplated as circumstances may suggest or render expedient, but such are intended to cover the application and\or implementation without departing from the spirit or scope of the claims.

What is claimed:

1. An extended table comprising:

a table having a table surface;

two or more leaves lying at least partially parallel in adjacent planes in an unextended position;

one or more crank arms supporting each leaf of the two or more leaves;

a gear assembly comprising a plurality of gears connecting the one or more crank arms together so that the one or more crank arms can be rotated simultaneously with respect to one another drawing the two or more leaves outward in an extended position and inward in the unextended position; and a snap and clamp means to block the rotation of at least one of the one or more crank arms and the plurality of gears in one or more of the positions.

2. The extended table of claim 1, wherein the surface shape of the two or more leaves may be such that the two or more leaves are concealed by a main table top in the unextended position.

3. The extended table of claim 1, wherein the surface shape of the two or more leaves may be such that the two or more leaves are placed side-by-side to the table surface in the extended position.

4. The extended table of claim 1, wherein the snap and clamp means is a U-shaped or V-shaped nylon clip.

5. The extended table of claim 1, wherein the table surface comprises a central portion that stretches to a shape delimited by the arcs of a circle at each end.

6. The extended table of claim 1, wherein the two or more leaves comprise circular leaves, and wherein the circular leaves have approximately the same radius as that of circular arcs of the table surface.

7. The extended table of claim 1, wherein the two or more leaves through manual operation in the horizontal plane and in a counterclockwise/clockwise direction through an angle, are driven by the gear assembly comprising the plurality of gears to execute a similar rotation in the same direction.

8. The extended table of claim 1, wherein the plurality of gears of the gear assembly comprises a central gear stationary gear, a first planetary gear, and a second planetary gear that are arranged in a powertrain manner.

9. The extended table of claim 1, wherein the plurality of gears of the gear assembly are made of high strength material, and wherein the high strength material is aluminum metal.

10. The extended table of claim 1, wherein edges of teeth of each of the plurality of gears are set at a predetermined angle.

11. The extended table of claim 1, wherein the one or more crank arms comprises a first mounting-boss portion and a second mounting-boss portion, with a first mounting means and a second mounting means located within the first and second mounting-boss portions.

12. The extended table of claim 1, further comprises a table base comprising a top base and a vertical column, connected to a horizontal base.

13. The extended table of claim 12, wherein an upper mounting plate is rigidly attached to the vertical column, aligned with the top base of the table base.

14. The extended table of claim 13, wherein the extended table is configured to engage a table top, with screws through apertures in the upper mounting plate.

15. The extended table of claim 13, wherein the extended table is designed for receiving and securely holding the gear assembly.

16. The extended table of claim 13, wherein the extended table includes circumferentially carved grooves to fit the snap and clamps means of the gear assembly.

17. An extended table assembly comprising:

a table having a table surface;

two or more leaves lying at least partially parallel in adjacent planes in an unextended position;

one or more crank arms supporting each leaf of the two or more leaves;

a gear assembly comprising a plurality of gears, wherein the plurality of gears comprises one center stationary gear and at least two planetary gears connecting the one or more crank arms together in a powertrain manner such that, the gear assembly causes simultaneous motion to draw the two or more leaves outward in an extended position and inward in the unextended position; and a snap and clamp means to block rotation of at least one of the one or more crank arms and the plurality of gears in one or more of the positions.

18. The extended table assembly of claim 17, wherein the center stationary gear of the gear assembly includes an elevated inner ring that acts as a track that is hingedly connected using the snap and clamp means equidistantly in coherence with the circumferential angular movement between the extended and the unextended positions.

19. The extended table assembly of claim 17, wherein the plurality of gears of the gear assembly are made of high strength material, and wherein the high strength material is aluminum metal.

* * * * *